US011833540B2

(12) United States Patent
Sasa et al.

(10) Patent No.: US 11,833,540 B2
(45) Date of Patent: Dec. 5, 2023

(54) CURTAIN APPLICATOR

(71) Applicant: VOITH PATENT GMBH, Heidenheim (DE)

(72) Inventors: Tadashi Sasa, Tokyo (JP); Toshihiro Katano, Motomiya (JP); Akio Hirano, Chiba (JP); Hiroyuki Kohno, Motomiya (JP); Christoph Henninger, Heidenheim (DE); Uwe Froehlich, Neu-Ulm (DE)

(73) Assignee: Voith Patent GmbH, Heidenheim (DE)

( * ) Notice: Subject to any disclaimer, the term of this patent is extended or adjusted under 35 U.S.C. 154(b) by 1174 days.

(21) Appl. No.: 16/305,091

(22) PCT Filed: May 11, 2017

(86) PCT No.: PCT/EP2017/061287
§ 371 (c)(1),
(2) Date: Nov. 28, 2018

(87) PCT Pub. No.: WO2017/207236
PCT Pub. Date: Dec. 7, 2017

(65) Prior Publication Data

US 2020/0316636 A1 Oct. 8, 2020

(30) Foreign Application Priority Data

May 30, 2016 (DE) ..... 10 2016 209 336.3

(51) Int. Cl.
*B05D 3/04* (2006.01)
*B05D 1/30* (2006.01)
(Continued)

(52) U.S. Cl.
CPC ..... *B05C 5/005* (2013.01); *B05D 1/305* (2013.01); *B05D 3/042* (2013.01); *D21H 23/48* (2013.01)

(58) Field of Classification Search
CPC ..... B05C 5/005; B05C 5/008; B05C 9/06; B05D 1/305; B05D 2252/02; B05D 3/042; D21H 23/48
See application file for complete search history.

(56) References Cited

U.S. PATENT DOCUMENTS 3,365,325 A * 1/1968 Fraenkel et al. ..... D21H 5/0045 427/420
5,224,996 A 7/1993 Ghys et al.
(Continued)

FOREIGN PATENT DOCUMENTS

DE 10359118 A1 7/2005
DE 102008054901 A1 6/2010
(Continued)

*Primary Examiner* — Alexander M Weddle
(74) *Attorney, Agent, or Firm* — Laurence A. Greenberg; Werner H. Stemer; Ralph E. Locher

(57) ABSTRACT

An applicator head for a curtain applicator for coating a continuous material web with liquid or pasty application medium. The applicator head has an outlet edge extending substantially over the width of the applicator head. The application medium passes out of the applicator head in a free-falling curtain. A rinsing device allows the outlet edge to be supplied with a flowing gaseous rinsing medium. There is also described a method for coating a continuous material web by way of such a curtain applicator. The application medium passes out of the applicator head in the form of a free-falling curtain and subsequently comes into contact with the material web. The region of at least one of the outlet edges can be supplied with a flowing gaseous rinsing medium.

2 Claims, 8 Drawing Sheets

(51) Int. Cl.
*D21H 23/48* (2006.01)
*B05C 5/00* (2006.01)

(56) References Cited

U.S. PATENT DOCUMENTS

| | | | | | |
|---|---|---|---|---|---|
| 5,624,715 | A | | 4/1997 | Gueggi et al. | |
| 5,683,036 | A | | 11/1997 | Benecke et al. | |
| 6,027,567 | A | * | 2/2000 | Suzuki | B05C 5/004 118/600 |
| 6,117,237 | A | * | 9/2000 | Yapel | B05C 5/0254 118/410 |
| 2010/0015346 | A1 | * | 1/2010 | Pape | B05B 7/025 427/424 |
| 2012/0058260 | A1 | * | 3/2012 | Arsten | C03C 17/006 427/162 |

FOREIGN PATENT DOCUMENTS

| | | | | | |
|---|---|---|---|---|---|
| DE | 102010042559 | A1 | | 4/2012 | |
| EP | 0489978 | A1 | | 6/1992 | |
| WO | 2004027153 | A1 | | 4/2004 | |
| WO | WO-2004027153 | A1 | * | 4/2004 | D21H 23/48 |

* cited by examiner

CURTAIN APPLICATOR

BACKGROUND OF THE INVENTION

Field of the Invention

The invention relates to an applicator head for a curtain applicator for coating a continuous fibrous web, a curtain applicator for coating a continuous fibrous web and a method of coating a continuous by means of a curtain applicator.

Curtain applicators for coating a continuous material web with at least one liquid and/or paste-like application medium typically have an applicator head that comprises at least one outlet edge that extends substantially over the width of the applicator head, at which the application medium exits the applicator head in the form of a free-falling curtain.

Curtain applicators are often used in the paper or B&P manufacturing to achieve a particularly high quality of coating while using little of the expensive coating coloring. Curtain applicators are therefore often used to generate the topmost or cover layer. Because the cover layer of the paper or B&P web is the layer that determines the appearance of the paper or board, the top layer is subject to particularly high quality requirements.

However, curtain applicators have the drawback that they are particularly sensitive to environmental conditions. For example, air flows and fluctuations in temperature and/or humidity have a particularly negative effect on the stability of curtain applicator operations. Because applicators are often arranged in close spatial proximity to drying devices, such as cylinder dryers and/or infrared dryers, such applicators are often operated in an environment that has a high ambient temperature combined with high humidity. To degas the coating color of curtain applicators, i.e., to ensure that the coating color is able to exit of the applicator head of the curtain applicator without generating air bubbles, vacuum degassing devices are additionally used, and these must be operated at a low temperature to prevent the coating color from boiling.

Because of the cool coating color fed into the applicator head, the warm ambient air may condense at the applicator head, and particularly at the outlet edge of the applicator head, and condensate drops may fall onto the fibrous web that is being manufactured. To prevent this, curtain applicators are usually operated in an enclosure that surrounds them and is air-conditioned.

The drawback of such air-conditioned enclosures is that air conditioning is very expensive, both as a purchase and as a matter of ongoing operation.

The objective of the present invention is to find a less expensive alternative to an air-conditioned enclosure, by means of which the condensation of ambient air at the applicator head may be reduced or inhibited in a similar or identical way as with air conditioning.

SUMMARY OF THE INVENTION

This objective is achieved by means of an applicator head as claimed, a curtain applicator as claimed, and a method as claimed.

Because at least one rinsing device is furnished according to the invention, and by means of the rinsing device, at least one of the at least one outlet edges is or may be supplied with a flowing gaseous rinsing medium, the result is achieved that little or no ambient air that may condense at the outlet edge is able to accumulate in the region of the outlet edge. For this reason, air conditioning may either be done away with completely, or only very simple air conditioning may be used.

Advantageous configurations and developments of the invention are set forth in the dependent claims.

The applicator head preferably comprises at least one transverse distribution chamber and a nozzle gap with an outlet opening, such that the application medium that comes to the outlet opening from the transverse distribution chamber via the nozzle gap exits the applicator head at the outlet opening, and the at least one outlet edge is formed by at least a part of the outlet opening. Specifically, in this context, the outlet opening may provide a first and second outlet edge, wherein if the applicator head is used in a normal way, the first outlet edge is arranged at the front and the second outlet edge is arranged at the rear, when viewed along the direction of travel of the material web.

In order particularly to rinse the outlet edges and reduce or prevent condensation of the ambient air there, a preferred development of the invention furnishes a first and/or a second rinsing device that is arranged such that, when the applicator head is used normally, as viewed along the direction of travel of the material web, the first rinsing device supplies the rinsing medium to the first outlet edge from the front and the second rinsing device supplies the rinsing medium to the second outlet edge from behind.

In an alternative embodiment to the foregoing embodiments, it is contemplated that the applicator head comprises at least one transverse distribution chamber and a nozzle gap connected thereto that has an outlet opening, as well as an adjoining sliding surface that in turn also adjoins the outlet edge in such a way that, viewed along the direction of flow of the application medium, the application medium, coming from the transverse distribution chamber via the nozzle gap and the outlet opening, flows past the outlet opening to the outlet edge via the sliding surface, and exits the applicator head at the outlet edge.

Specifically, the at least one rinsing device may be arranged outside the nozzle gap.

Preferably, the at least one rinsing device is designed and arranged in such a way that the flow of the gaseous rinsing medium is directed toward the free-falling curtain.

Specifically, the applicator head may comprise a housing block, in particular of a metallic material, in which the transverse distribution chamber and the nozzle gap are arranged, wherein the housing block is surrounded at least in sections by an outer lining and/or a thermally insulating layer that comes into contact with the environment.

The outer lining may in this case, for example, be provided at least in sections by, or may comprise, at least one flat and/or bent metal sheet or at least one flat and/or bent plastic sheet such as, for example, a Plexiglas sheet.

According to a specific configuration, the outer lining may be thermally decoupled from the housing block, at least in sections, by the thermally insulating layer. In this case, the thermally insulating layer is arranged, at least in sections, between the outer lining and the housing block. As a result of the outer lining that is thermally decoupled from the housing block, the result is achieved that the ambient air does not come into direct contact with the "cool" housing block through which the application medium is fed.

According to a further alternative configuration of the invention, the outer lining may also be formed at least in sections by a thermally insulating layer.

Preferably, the outer lining, at least in the area of the outlet edge, is arranged and designed such that it does not affect the free fall of the curtain.

According to a further specific configuration of the invention, the housing block comprises a first and second housing block part and the transverse distribution chamber and nozzle gap are formed by a cavity formed between the two housing block parts. In this context, the two housing block parts in particular are connected together by connecting means, particularly screws.

In addition, it is particularly appropriate if the first housing block part comprises a first nozzle lip that provides the first outlet edge and the second housing block part comprises a second nozzle lip that provides the second outlet edge, and these nozzle lips may be adjusted relative to one another such that the width of the nozzle gap in the region of the outlet opening may be individually adjusted in the transverse direction of the applicator head, and thus in the transverse direction of the fibrous web. By means of this configuration, the applicator head according to the invention may be constructed with a particularly simple construction having an adjustable nozzle gap.

Various possible ways of constructing the thermally insulating layer are conceivable.

According to a conceivable variant, the thermally insulating layer comprises a foam material and/or a honeycomb structure and/or glass wool and/or mineral wool or is formed by one or more of the foregoing.

According to another conceivable variant, the thermally insulating layer is formed by a gaseous insulation medium, which is arranged or fed inside a gap between the housing block and the outer lining, and in particular the gap, in the vicinity of the outlet edge, is in the 0.5 mm-50 mm range, preferably 2-10 mm. In this case, it is particularly advantageous if the gaseous insulation medium is at least partially, and preferably completely, provided by the flowing gaseous rinsing medium. In this case, insulation of the housing block as well as rinsing of the at least one outlet edge may be provided in a particularly simple manner.

Specifically, the gaseous insulation medium and/or gaseous rinsing medium is in particular air.

According to a further preferred specific configuration of the invention, the applicator head has an upper side and a lower side and the outlet opening is arranged on the lower side. In this case, it is particularly useful if the rinsing medium, which at least partially provides the insulation medium, flows to the region of the outlet edge in a flow direction that is directed from the upper side to the lower side, and in particular from the upper side to the lower side.

According to a further independent aspect of the invention, a curtain applicator for coating a continuous material web with at least one liquid and/or paste-like medium is proposed, the curtain applicator being equipped with at least one applicator head according to the invention.

Preferably, the curtain applicator has means for adjusting the temperature of the rinsing medium and/or the application medium in such a way that the temperature of the rinsing medium is between the ambient temperature and the temperature of the application medium. These means are in particular designed to adjust the temperature of the rinsing medium in the range of 0.4 times to 1.5 times, preferably from 0.6 times to 1.5 times, the ambient temperature. The means for adjusting or matching the temperatures of the rinsing medium and/or the application medium may in particular comprise heating and/or cooling devices and temperature measuring devices, by means of which the temperature of the rinsing medium and the application medium may be measured and respectively adjusted to a desired value. Preferably, these means further comprise a control and/or regulating device by means which the heating and/or cooling devices are automatically controlled and/or regulated on the basis of the measured temperatures of the rinsing medium and the application medium and the set temperatures for the rinsing medium and the application medium.

Preferably, the curtain applicator comprises means for dehumidifying the rinsing medium.

By means of the invention, in is possible in particular for the curtain applicator to have no enclosure.

Alternatively, it is conceivable that the curtain applicator has an enclosure that is not air-conditioned.

In the present cases, the enclosure is designed in particular in such a way that it surrounds at least the applicator head and the area where the curtain of the application medium strikes the fibrous web.

According to a further independent aspect of the invention, a method is proposed for coating a continuous material web with at least one liquid and/or paste-like application medium by means of a curtain applicator, which comprises at least one applicator head according to the invention, namely the at least one outlet edge extending substantially over its width the application medium leaves the applicator head in the form of a free-falling curtain and subsequently enters the material web, the region of at least one of the at least one separation edges being exposed to a flowing gaseous rinsing medium.

A preferred configuration of the method provides that the temperature of the rinsing medium is kept between the ambient temperature and the temperature of the application medium. In this context, it may be particularly conceived that the temperature of the rinsing medium is in the range from 15° C. to 55° C., the temperature of the application medium is in the range from 18° C. to 40° C., and the ambient temperature is less than 65° C. The temperature of the rinsing medium preferably deviates from the temperature of the application medium by a maximum of 7° C., particularly preferably by a maximum of 5° C. In particular, the temperature of the rinsing medium is preferably less than the temperature of the application medium by a maximum of 7° C., particularly preferably a maximum of 5° C.

BRIEF DESCRIPTION OF THE SEVERAL VIEWS OF THE DRAWING

The invention will be further explained in the following with reference to schematic drawings, which are not to scale. The drawings show the following.

DESCRIPTION OF THE INVENTION

Figure 1:
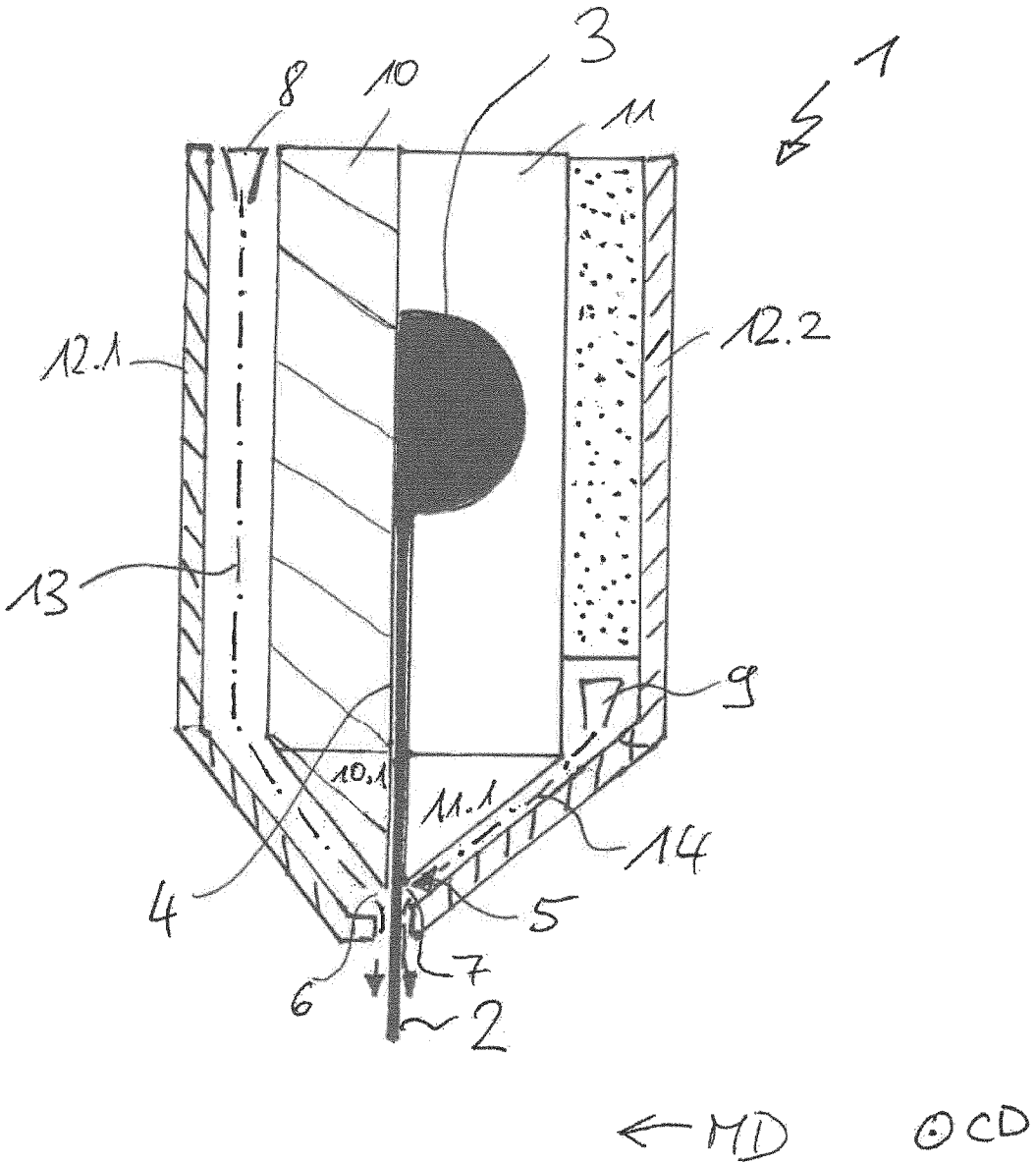
FIG. 1 shows a first embodiment of an applicator head according to the invention for generating a single-layer free-falling curtain.

FIG. 1 shows—in a cross-sectional view in a plane parallel to the web movement direction MD and perpendicular to the web transverse direction CD (CD extends perpendicular to the plane of the drawing in FIGS. 1-7)—a first embodiment of an applicator head 1 according to the invention for manufacturing a single-layer free-falling curtain 2 of a liquid and/or paste-like application medium for coating a continuous material web.

The applicator head 1 has a transverse distribution chamber 3 and a nozzle gap 4 connected thereto, having the outlet opening 5, such that the application medium coming from the transverse distribution chamber 3 to the outlet opening 5 via the nozzle gap 4 exits the applicator head at the outlet opening 5.

In the present case, viewed in the web movement direction MD, the outlet opening 5 provides a front outlet edge 6 and a rear outlet edge 7.

As is apparent from the illustration in FIG. 1, the applicator head 1 comprises a first rinsing device and a second rinsing device 9 that are designed and arranged in such a way that, when the applicator head is in normal use, the first rinsing device 8 supplies the first outlet edge 6 from the front with a flowing rinsing medium 13 (dash-dotted line with arrow) and the second rinsing device 9 supplies the second outlet edge 7 from behind with a flowing rinsing medium 14 (dash-dotted line with arrow), as viewed in the movement direction of the material web. In the present exemplary embodiment, the two rinsing devices 8, 9 are both arranged outside of the nozzle gap 4. In the present case, each of the two rinsing devices provides a rinsing medium in the form of air.

The applicator head 1 comprises a housing block made of a metallic material, in which the transverse distribution chamber 3 and the nozzle gap 4 are arranged. The housing block comprises a first housing block part 10 (front housing block part 10 in the present embodiment) and a second housing block part 11 (rear housing block part 11 in the present embodiment), and the transverse distribution chamber 3 and the nozzle gap 4 are formed by a cavity formed between the two housing block parts 10, 11. As illustrated in FIG. 1, the first housing block part 10 comprises a first nozzle lip 10.1, which the first outlet edge 6 provides in the region of the outlet opening 5 of the nozzle gap 4. In addition, the second housing block part 11 comprises a second nozzle lip 11.1, which provides the second outlet edge 7 in the region of the outlet opening 5 of the nozzle gap 4. The two nozzle lips 10.1 and 11.1 may be adjusted relative to one another in such a way that the width of the nozzle gap 4 in the region of the outlet opening 5 in the transverse direction of the applicator head may be individually adjusted.

In the present exemplary embodiment, the housing block is surrounded in sections by an outer lining 12.1, 12.2, which comes into contact with the environment. The outer lining 12.1, 12.2 in this case has a front part, in the web movement direction MD, of the outer covering 12.1, in the form of a bent metal sheet; and a rear part of the outer covering 12.2, in the direction of web travel MD, in the form of a bent metal sheet. As may also be seen, the outer lining 12.1, 12.2 in the region of the outlet edges 6, 7 is arranged and designed in such a way that the free fall of the curtain 2 is not affected thereby.

The outer lining 12 is thermally decoupled from the housing block 10, 11, at least in sections, by a thermally insulating layer.

In the present case, the thermally insulating layer between the front part of the outer lining 12.1 and the front housing block part 10 is formed by a gaseous insulation medium that is fed in a gap between the front housing block part 10 and the front part of the outer lining 12.1, and is provided by the flowing gaseous rinsing medium 13 the first rinsing device 8.

In addition, in the present case, the upper part of the gap between the rear housing block part 11 in FIG. 1 and the rear part of the outer lining 12.2 is formed by a foam material. It may further be seen that the lower part of the gap between the rear housing block part 11 and the rear part of the outer lining 12.2, which adjoins the upper part in FIG. 1, is formed by a gaseous insulation medium that is protected by the flowing gaseous rinsing medium 14, which is provided by the second rinsing device 9.

In both cases, with regard to both the first rinsing device 8 and the second rinsing device 9, the rinsing medium flows toward the two outlet edges 6, 7 in a flow direction running from the upper side to the lower side.

For the following discussion of FIGS. 1*b* and 2 to 6, it should be noted that only the differences from the respective explicitly-mentioned embodiment (for example the embodiment of FIG. 1) are discussed, and that the same or similar technical subject matter or features are designated by the same reference numerals.

Figure 1B:
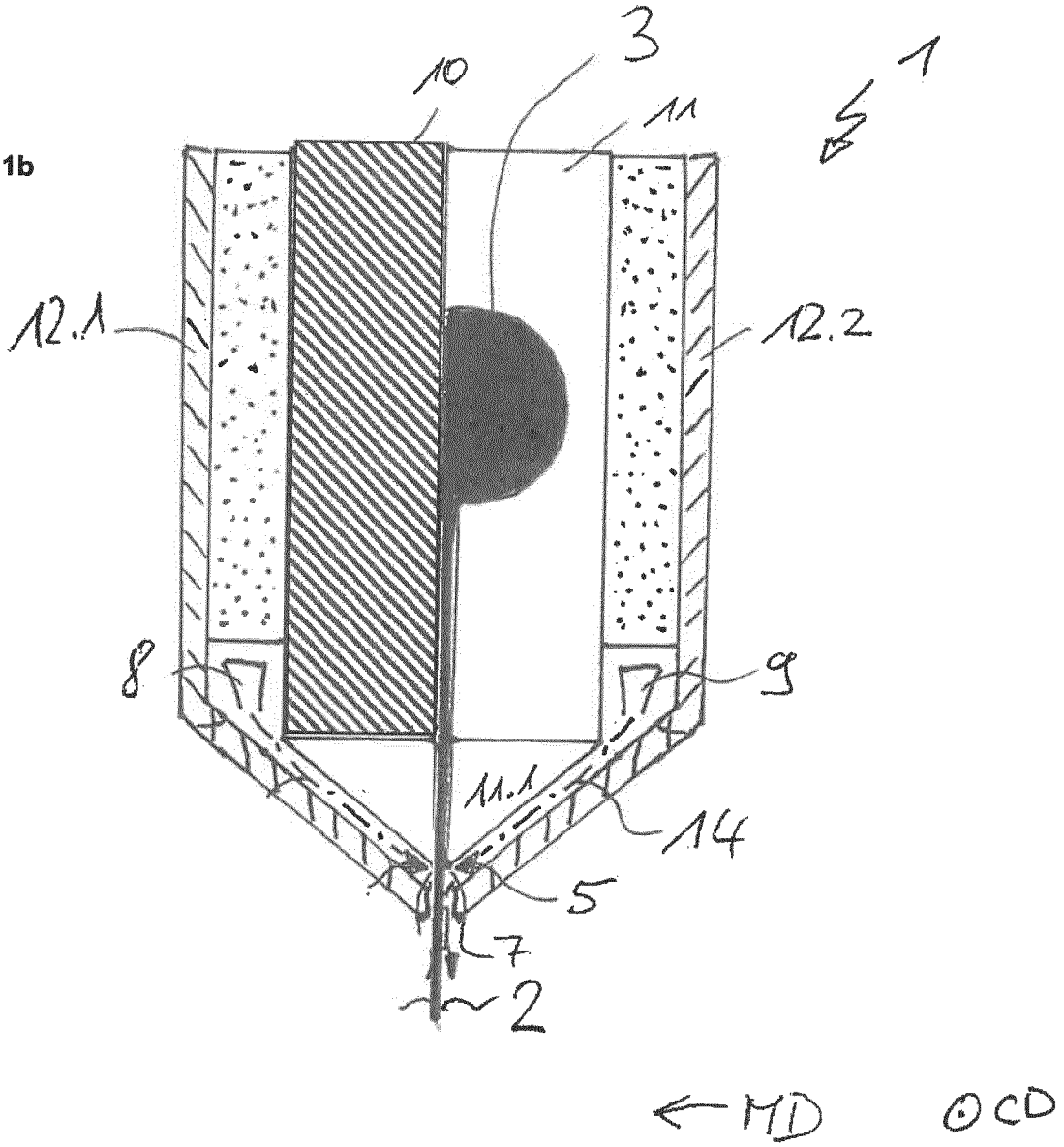
FIG. 1*b* shows a variant of the first embodiment of an applicator head according to the invention, for generating a single-layer free-falling curtain.

FIG. 1*b* shows a variant of the applicator head shown in FIG. 1. In this case, both of the rinsing devices 8, 9 are mounted in the lower region of the nozzle head. The upper part of the gap between the rear housing block part 11 and the rear part of the outer lining, 12.2, as well as the upper part of the gap between the front housing block part 10 and the front part of the outer lining, 12.1, is in this case completely or at least partially filled by a foam material.

Figure 2:
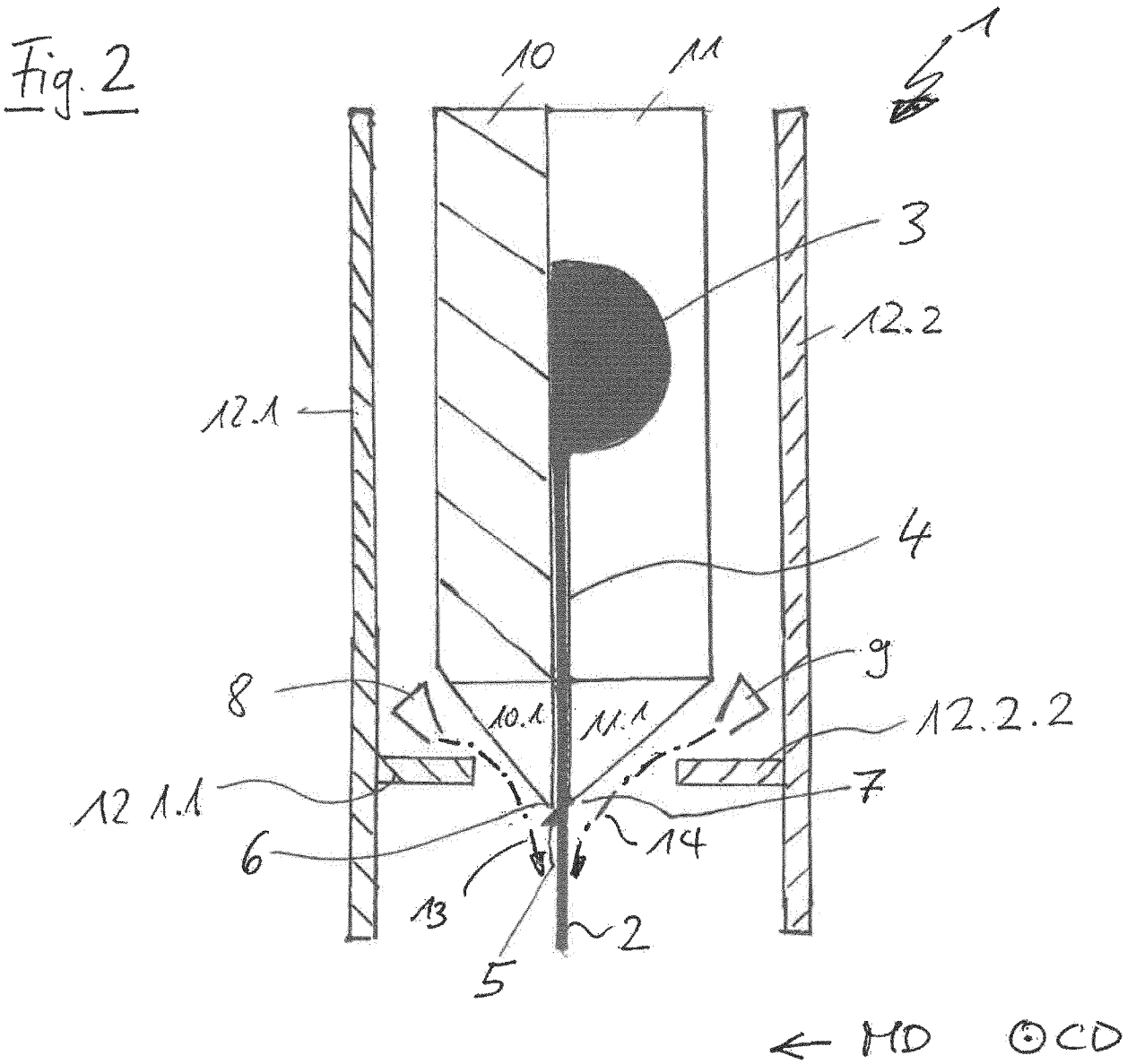
FIG. 2 shows a second embodiment of an applicator head according to the invention for generating a single-layer free-falling curtain.

FIG. 2 shows a second embodiment of an applicator head 1 according to the invention for generating a single-layer free-falling curtain 2.

The applicator head of FIG. 2 differs substantially from the applicator head shown in FIG. 1 in that in the applicator head of FIG. 2, both rinsing device 8, 9 are arranged in the lower region of the applicator head 1, i.e. at the level of the nozzle lips 10.1 and 11.1, and the outer lining 12.1 and 12.2 protrudes by up to 100 millimeters beyond the two outlet edges 6, 7 at the outlet opening 5 both in front and behind the curtain, in the direction of the free-falling curtain 2; and as a result, the free-falling curtain 2 is shielded from environmental disturbances such as air currents.

In order to direct the flowing rinsing medium 13 provided by the first rinsing device 8 onto the first outlet edge 6, the front part of the outer lining 12.1 comprises a deflection plate 12.1.1. Analogously, the rear part of the outer lining 12.2 comprises a deflection plate 12.2.2, whereby the flowing rinsing medium 14 provided by the second rinsing device 9 is directed onto the second outlet edge 7.

As a further difference from FIG. 1, the thermally insulating layer between the front part of the outer lining 12.1 and the housing block 10, 11, as well as between the rear part of the outer lining 12.2 and the housing block 10, 11, is respectively provided by air, which is not provided by the rinsing medium 13, 14. However, it may also be contemplated that instead of air, a different thermally insulating layer such as foam, mineral wool, etc. is used.

Figure 3:
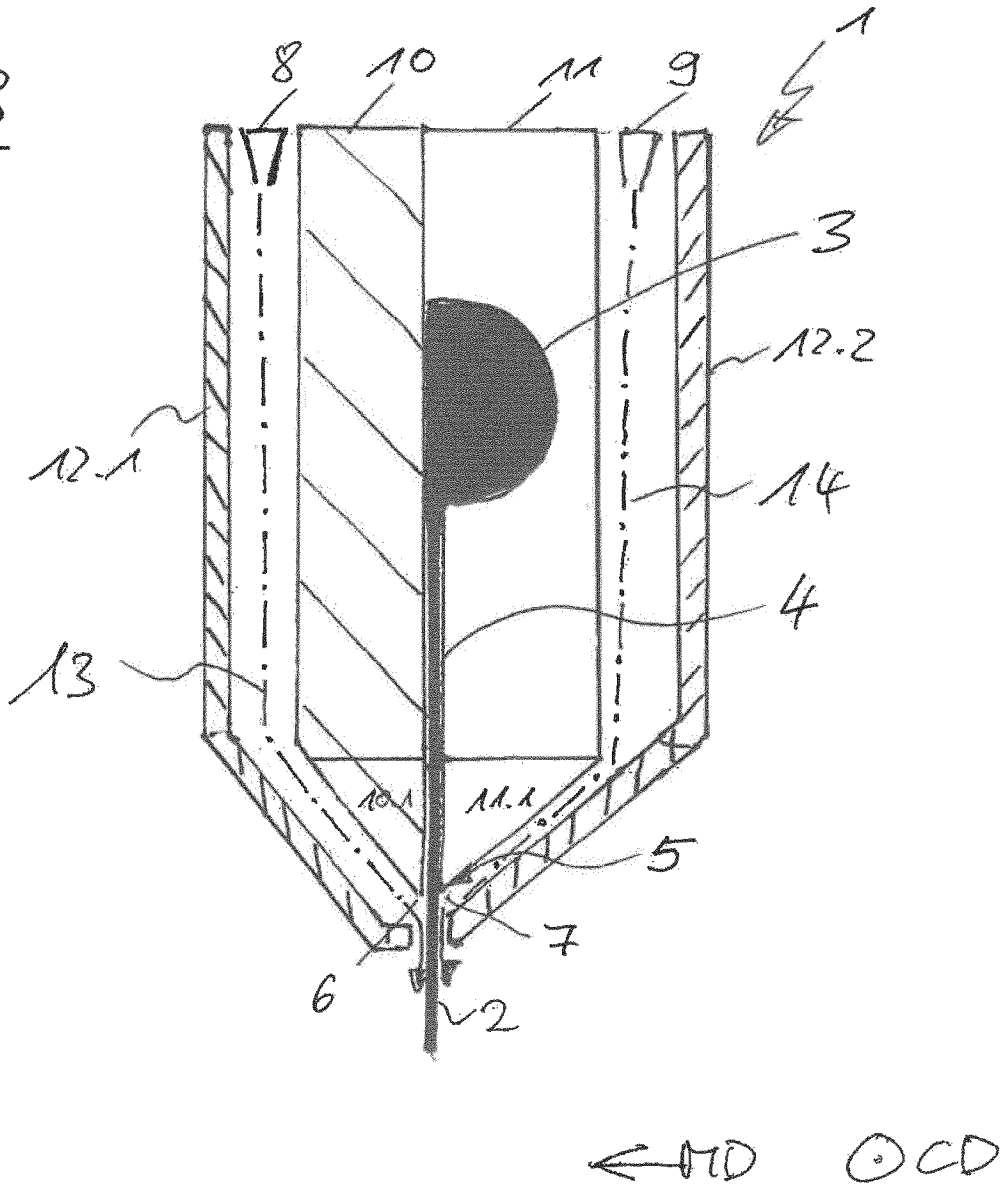
FIG. 3 shows a third embodiment of an applicator head according to the invention for generating a single-layer free-falling curtain.

FIG. 3 shows a third embodiment of an applicator head 1 according to the invention for generating a single-layer free-falling curtain 2.

The applicator head 1 of FIG. 3 differs substantially from the applicator head shown in FIG. 1 in that the thermally insulating layer between the rear part of the outer covering 12.2 and the rear housing block part 11 is also formed by the gaseous insulation medium that is fed into the gap between the rear housing block part 11 and the rear part of the outer lining 12.2 is fed and is provided by the flowing gaseous rinsing medium 14 from the second rinsing device 9.

Figure 4:
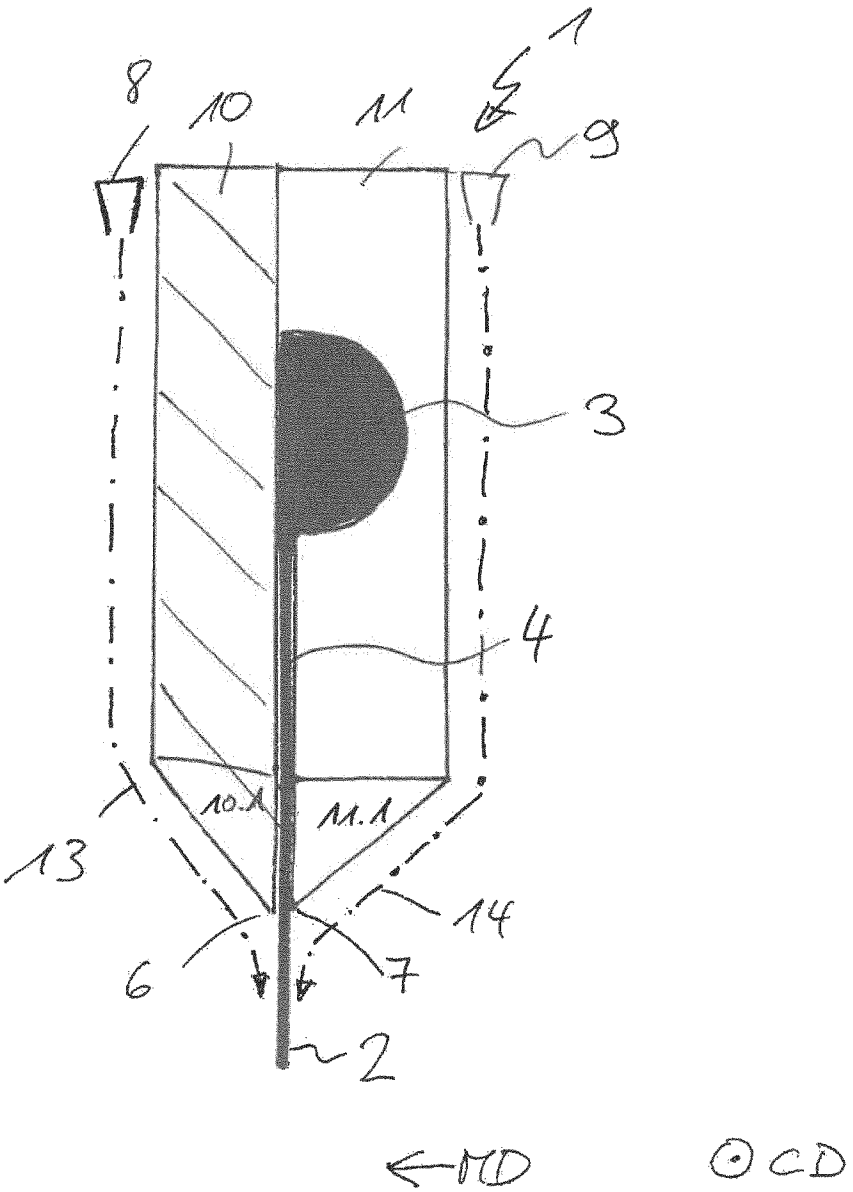
FIG. 4 shows a fourth embodiment of an applicator head according to the invention for generating a single-layer free-falling curtain.

FIG. 4 shows a fourth embodiment of an applicator head 1 according to the invention for generating a single-layer free-falling curtain 2.

The applicator head 1 of FIG. 4 differs substantially from the applicator head shown in FIG. 3 in that no outer lining 12.1 and 12.2 is furnished.

In the present exemplary embodiment, the housing block 10, 11 is surrounded only by the thermally insulating layer, which comes into contact with the environment, wherein the thermally insulating layer surrounding the front housing block part 10 is provided by the flowing gaseous rinsing medium 13 from the first rinsing device 8, and the thermally insulating layer that surrounds the rear housing block part 11 is provided by the flowing gaseous rinsing medium 14 from the second rinsing device 9.

Figure 5:
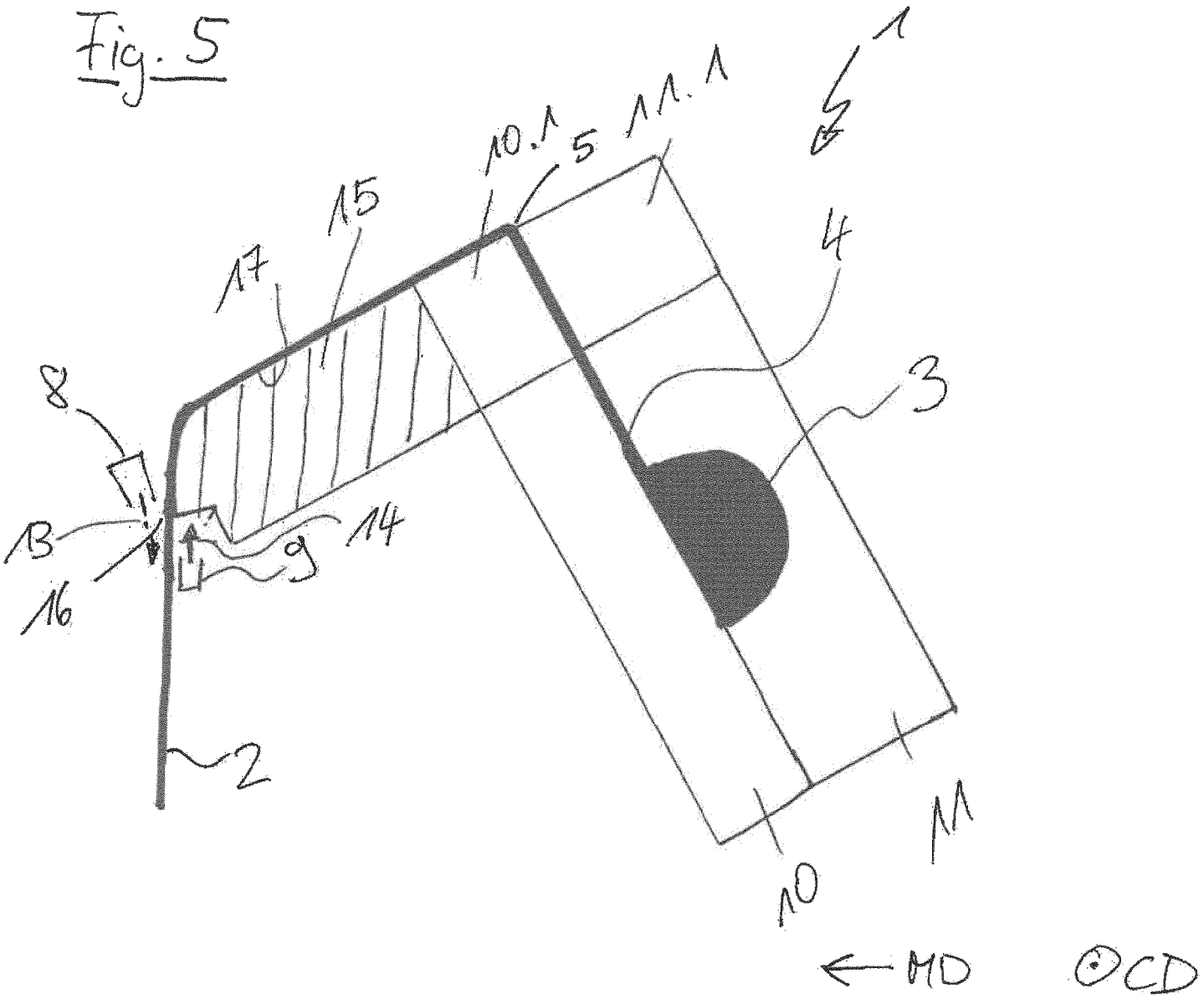
FIG. 5 shows a fifth embodiment of an applicator head according to the invention, having a sliding surface for generating a single-layer free-falling curtain.

FIG. 5 shows a fifth embodiment of an applicator head 1 according to the invention for generating a single-layer free-falling curtain 2.

The applicator head 1 of FIG. 5 has a transverse distribution chamber 3 and a nozzle gap 4 connected thereto, having an outlet opening 5 and an adjoining sliding surface 17, which in turn is adjoined by a outlet edge 16 in such a way that, viewed in the direction of flow of the application medium, the application medium that comes from the transverse distribution chamber 3 via the nozzle gap 4 and the outlet opening 5, flows past the outlet opening via the sliding surface 17 to the outlet edge 16 and then after passing the outlet opening 5, exits the applicator head 1 at the outlet edge 16. Notably, the sliding surface 17 is provided by a sliding surface block 15 arranged on the front housing block part 10.

At the outlet edge 16, two rinsing devices 8, 9 are furnished, and by means of these, the flowing gaseous rinsing medium 13, 14 may be supplied by means of the outlet edge 16.

Figure 6:
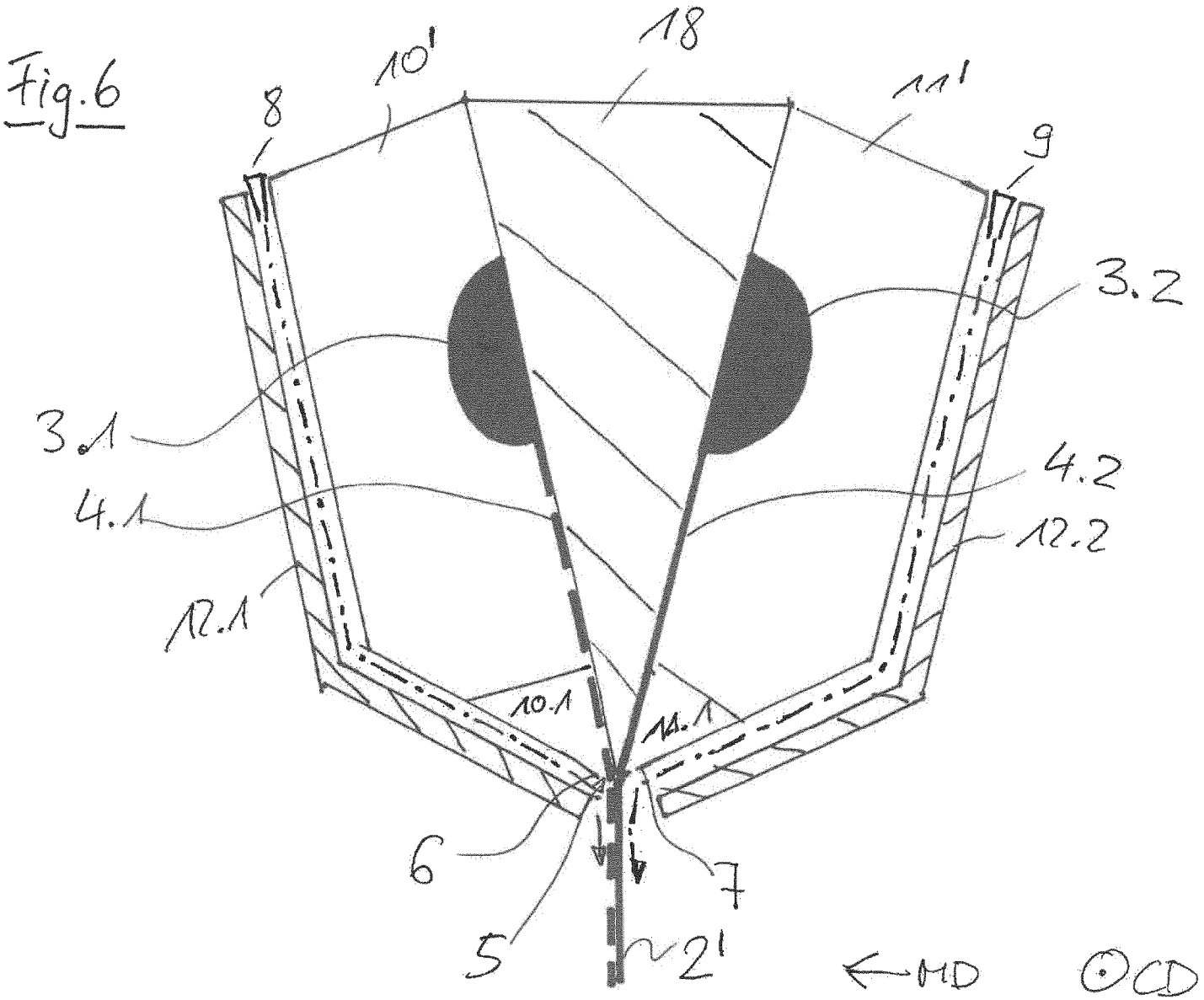
FIG. 6 shows an embodiment of an applicator head according to the invention for producing a multilayer free-falling curtain.

FIG. 6 shows an embodiment of an applicator head 1 according to the invention for generating a multi-layer free-falling curtain 2'.

The applicator head 1 of FIG. 6 differs substantially from the applicator head shown in FIG. 3 in that, in addition to a front and rear housing block part 10', 11', the housing block has a housing block middle part 18, and two transverse distribution chambers 3.1 and 3.2 that are respectively provided with a nozzle gap 4.1, 4.2 associated therewith, and these meet at the outlet opening 5 to generate a two-layer free-falling curtain 2 '. The supply to the two outlet edges 6, 7 and the thermal insulation of the housing block 10', 11', 18 is achieved analogously to the embodiment of FIG. 3, namely by supplying the first outlet edge 6 with the rinsing medium 13 provided by the first rinsing device 8 and supplying the second outlet edge 7 with the rinsing medium 14 provided by the second rinsing device 9, with the two rinsing media 13, 14 being fed respectively into the gap between the outer lining 12.1 and 12.2 in a flow direction running from the upper side to the lower side of the housing block 10 ', 11', 18.

Figure 7:
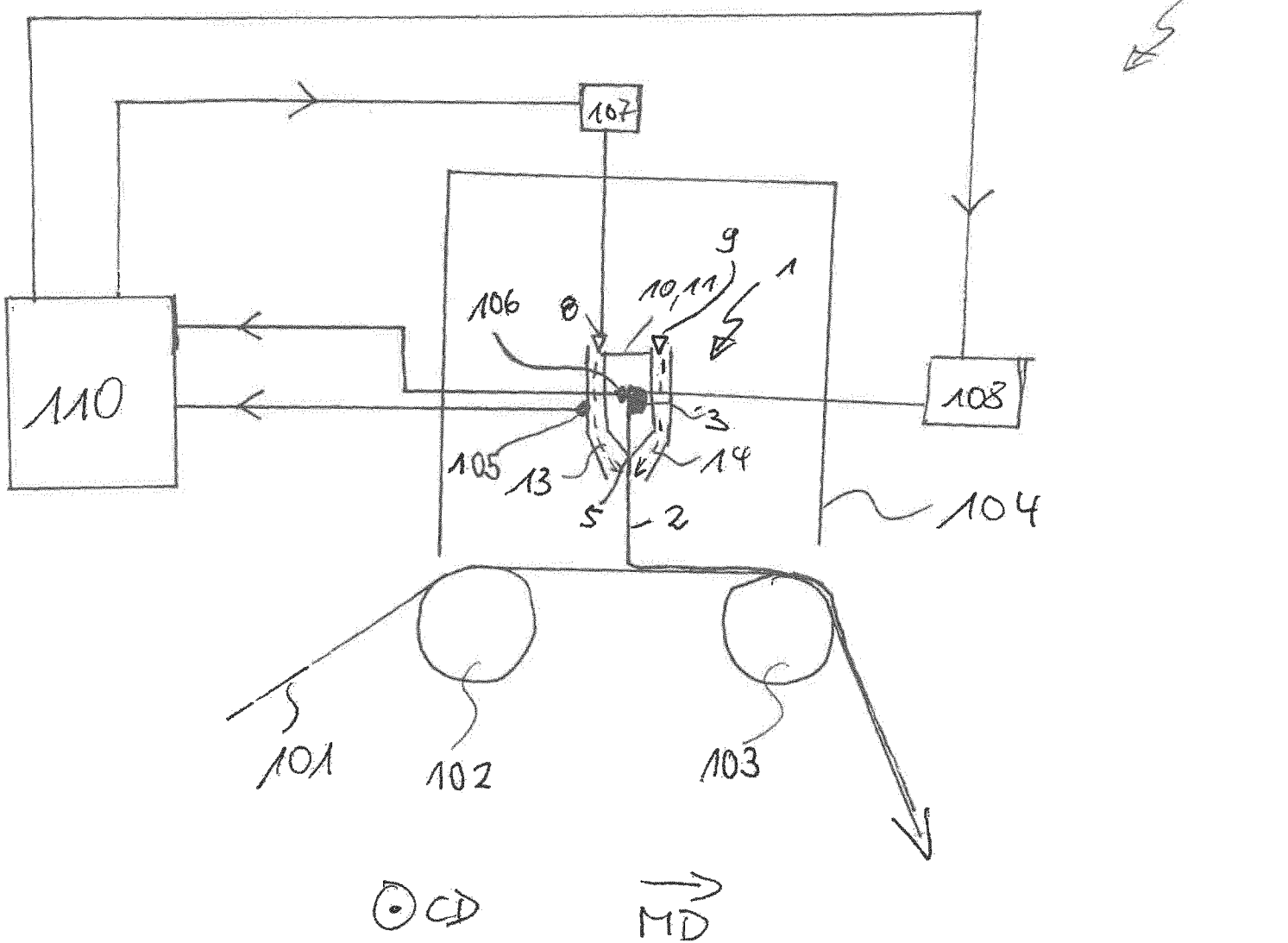
FIG. 7 shows an embodiment of a curtain applicator according to the invention.

FIG. 7 shows an embodiment of a curtain applicator 100 according to the invention for coating a continuous paper web with a liquid and/or paste-like application medium in the form of a free-falling curtain 2. By way of example, in the present exemplary embodiment, an applicator head as shown in FIG. 3 is used. Notably in this context, any other applicator head according to the invention could be used instead of the applicator head of FIG. 3.

The curtain applicator 100 has rollers 102, 103 over which the paper web 101 is fed substantially horizontally during coating. The applicator head 1 and the point at which the free-falling curtain 2 meets the paper web 101 are shielded from environmental conditions by an enclosure 104 that is not air-conditioned.

The curtain applicator 100 has means for adjusting the temperature of the rinsing medium 13, 14 and the application medium 2 in such a way that the temperature of the rinsing medium 13, 14 is between the ambient temperature and the temperature of the application medium 2.

Specifically, these means comprise a temperature sensor 105 for measuring the temperature of the rinsing medium 13, 14 and a temperature sensor 106 for measuring the temperature of the application medium 2 in the region of the transverse distribution chamber 3. The means further comprise a heating and/or cooling device 107 for increasing and/or reducing the temperature of the rinsing medium 13, 14, and a heating and/or cooling device 108 for increasing and/or reducing the temperature of the application medium 2.

As a further element, the means comprise a control and/or regulating device 110, by means of which the two heating and/or cooling devices 108, 109 are controlled and/or regulated automatically based on the measured temperatures of the rinsing medium 13, 14 and the application medium 2 and the set temperatures for the rinsing medium 13, 14 and the application medium 2. Specifically, by means of a control and regulation unit 110, in the event of deviations of the actual value from the set value of the temperature of the rinsing medium 13, 14 and the application medium 2, the respective temperature may be readjusted and/or controlled automatically by means of the respective associated heating and/or cooling device 107, 108.

The invention claimed is:

1. A method for coating a continuous material web with a liquid and/or pasty application medium, the method comprising:

providing at least one applicator head formed with at least one outlet edge that extends substantially over an entire width of the applicator head;

providing a housing block having a transverse distribution chamber and a nozzle gap formed therein, and said housing block being surrounded at least in sections by an outer lining, where most of a front of said housing block, in a web movement direction, is surrounded by said outer lining and a thermally insulating layer that comes into contact with an exterior of the housing block;

causing application medium to pass out of the applicator head in the form of a free-falling curtain and to subsequently come into contact with the material web; and selectively subjecting a region of at least one of the at least one outlet edges to a flowing gaseous rinsing medium; and at least partially forming the thermally insulating layer by a gaseous insulation medium at least partially provided by the flow of gaseous rinsing medium inside a gap between said housing block and said outer lining; and wherein the applicator head has an upper side and a lower side and said outlet opening is formed at said lower side, causing the rinsing medium that at least partially provides the insulation medium to flow downwardly to said outlet edge.

2. The method according to claim 1, which comprises maintaining a temperature of the rinsing medium between an ambient temperature and a temperature of the application medium, and/or maintaining the temperature of the rinsing medium in a range from 15° C. to 55° C., maintaining the temperature of the application medium in a range from 18° C. to 40° C., and wherein an ambient temperature is less than 65° C.

* * * * *